US006372300B1

(12) United States Patent
Angelo

(10) Patent No.: US 6,372,300 B1
(45) Date of Patent: Apr. 16, 2002

(54) THERMAL SPRAY VEHICLE BODY MANUFACTURING PROCESS

(75) Inventor: Dennis Angelo, Troy, MI (US)

(73) Assignee: Design Analysis, Inc., Wood Dale, IL (US)

( * ) Notice: Subject to any disclaimer, the term of this patent is extended or adjusted under 35 U.S.C. 154(b) by 0 days.

(21) Appl. No.: 09/511,335

(22) Filed: Feb. 23, 2000

(51) Int. Cl.[7] ..... C23C 4/06
(52) U.S. Cl. ..... 427/456; 427/455
(58) Field of Search ..... 427/455, 456

(56) References Cited

U.S. PATENT DOCUMENTS

| | | | | |
|---|---|---|---|---|
| 3,947,607 A | | 3/1976 | Gazzard et al. | 427/37 |
| 4,095,081 A | | 6/1978 | Ashman | 219/76.16 |
| 4,148,971 A | * | 4/1979 | Kawano et al. | 428/558 |
| 4,302,483 A | | 11/1981 | Altorfer | 427/37 |
| 4,395,279 A | | 7/1983 | Houck | 75/0.5 BB |
| 4,547,415 A | | 10/1985 | Schultze et al. | 428/36 |
| 4,714,623 A | | 12/1987 | Riccio et al. | 427/27 |
| 4,970,091 A | | 11/1990 | Buhrmaster et al. | 427/34 |
| 5,013,587 A | * | 5/1991 | Kiilunen et al. | 427/383.7 |
| 5,206,059 A | | 4/1993 | Marantz | 427/449 |
| 5,453,173 A | | 9/1995 | Oyama | 205/70 |
| 5,648,158 A | * | 7/1997 | Pfeffer | 428/325 |
| 5,716,422 A | | 2/1998 | Muffoletto et al. | 29/623.5 |
| 5,879,817 A | | 3/1999 | Brown, Jr. et al. | 428/629 |

FOREIGN PATENT DOCUMENTS

| | | | |
|---|---|---|---|
| GB | 2 335 202 | * | 9/1999 |
| JP | 63-116782 | * | 5/1988 |

OTHER PUBLICATIONS

Nasa Tech Briefs vol. 19 No. 5, p. 84, May 1995 Bonds, et al., Wire–Arc Spraying of Metal Onto Insulating Foam.

* cited by examiner

*Primary Examiner*—Katherine A. Bareford

(57) ABSTRACT

A process for manufacturing automotive vehicle bodies using a formed substrate material (10), a thermal spray coating (20), and a means to cover the portions of the formed substrate deemed necessary. The formed substrate is of predetermined cross-sectional design and the thermal spray thickness is allowed to vary in a predetermined manner.

3 Claims, 2 Drawing Sheets

THERMAL SPRAY VEHICLE BODY MANUFACTURING PROCESS

BACKGROUND—FIELD OF INVENTION

This invention relates to the manufacturing process for automotive vehicle bodies including those for passenger cars, trucks, and sport utility vehicles.

BACKGROUND—DESCRIPTION OF PRIOR ART

Automobile manufacturers commonly produce automotive vehicle bodies that are primarily comprised of formed metal body panels. These panels are typically formed by cutting and stamping initially flat sheets of metal in an elaborate multi-stage die stamping process. Such formed metal panels are subsequently fastened together to form subassemblies and final assemblies which define the vehicle architecture. This architecture serves as the partial exterior of the vehicle as well as its primary structure in many cases. Fastening methods for the metal panels and subassemblies include spot welding, laser welding, screwing, riveting, bolting, clinching, and structural adhesives.

Current automotive body assemblies are therefore primarily weldments of smaller pieces of formed sheet metal. In order to accommodate the welding process, flanges for weld placement are often created along the edges of the formed sheet metal. These flanges have the effect of increasing the amount of material in the weld regions, adding mass, and hence weight, to the vehicle body. In addition, the welds are the primary load path between mating components and constitute a structural discontinuity between the parent parts. Should these welds fail or be poorly executed, the structural integrity of the assembly can be compromised.

Some formed metal panels, for example the front fenders and hood, are considered to be non-structural and of little value for crashworthiness. They exist primarily for general closure, vehicle aerodynamics, and styling purposes.

Several manufacturers have substituted aluminum or plastic panels for some of the steel body components. Examples include the hood, fenders and deck lid. One plastic material commonly employed is sheet molding compound. These components must be attached to the remaining structure using a variety of methods including adhesives and fasteners.

Vehicle bodies manufactured by existing processes are comprised of a significant number of individual parts. Spot welding, the predominant method of attaching these parts together, is an expensive process requiring extensive support facilities.

Thermal spray is a material deposition technique in which a material initially in solid form is melted or softened and then propelled onto the surface of a substrate material to form an exterior coating. Once the molten metal has solidified, the substrate material benefits from the presence of a superior material on its exterior surface. In this scenario, the substrate surfaces provide location for the thermal spray material. Prior to melting, the metal can exist in wire form, powder form, or other forms suitable to the application.

Thermal spray processes can be classified by the two methods that are used to generate heat, namely electrical heating and chemical combustion. Electrical heating includes plasma spraying and wire arc spraying. Chemical combustion includes detonation/explosive flame spraying, wire/rod flame spraying, and powder flame spraying.

Marine applications include the use of thermally sprayed coating materials for protection from aquatic environment.

Computer industry usage of thermal spray includes coating computer components with aluminum in order to suppress electromagnetic interference. Automotive applications include the coating of internal combustion engine cylinder bores in order to achieve desirable surface qualities.

OBJECTS AND ADVANTAGES

Accordingly, several objects and advantages of the present invention are:

(a) to enable the production of a structurally superior and lighter weight vehicle body structure through the usage of an optimized formed substrate in conjunction with variable exterior thermal spray material thicknesses—in other words to apply customizeable spray material thicknesses as needed to a well designed vehicle body core shape;

(b) to allow the design and production of a lighter weight automotive vehicle which obtains greater fuel economy and therefore saves energy;

(c) to reduce or eliminate sheet metal stamping in the manufacture of automotive vehicle bodies;

(d) to reduce or eliminate welding and the manufacturing challenges associated with it for automotive vehicle bodies;

(e) to reduce the amount of material required in vehicle bodies by reducing or eliminating the flanges that welding requires in assemblies and subassemblies;

(f) to produce a more continuous vehicle body design by enabling the creation of larger vehicle body components;

(g) to allow for a reduction in the number of separate parts required in a vehicle body—in other words to reduce the part count in a vehicle body;

(h) to enable the creation of a closed sandwich composite structure fabricated by thermal spraying on all sides of a substrate core material;

(i) to enable the creation of an open composite structure by thermal spraying on only some sides of a substrate core material;

(j) to facilitate the fabrication of rapid prototype vehicle structures by the application of thermal spray to hand-shaped or machined substrate cores;

(k) to facilitate the fabrication of production vehicle structures by the application of thermal spray to molded substrate cores.

Further objects and advantages are the ability to design and manufacture a more rigid body structure which provides for increased vehicle occupant safety, and which promotes improved vehicle dynamics including acceleration, braking and handling. Still further objects and advantages will become apparent from a consideration of the ensuing description and drawings.

DRAWING FIGURES

REFERENCE NUMERALS IN DRAWINGS

10 formed substrate in the shape of a vehicle body core
20 thermal spray material
30 thermal spray device
30' optional second thermal device (many possible)

SUMMARY

In accordance with the present invention a formed substrate core material in the approximate shape of an automotive vehicle body is coated with a thermal spray material to produce an automotive vehicle body.

DESCRIPTION—FIGS. 1 TO 3

Figure 1:
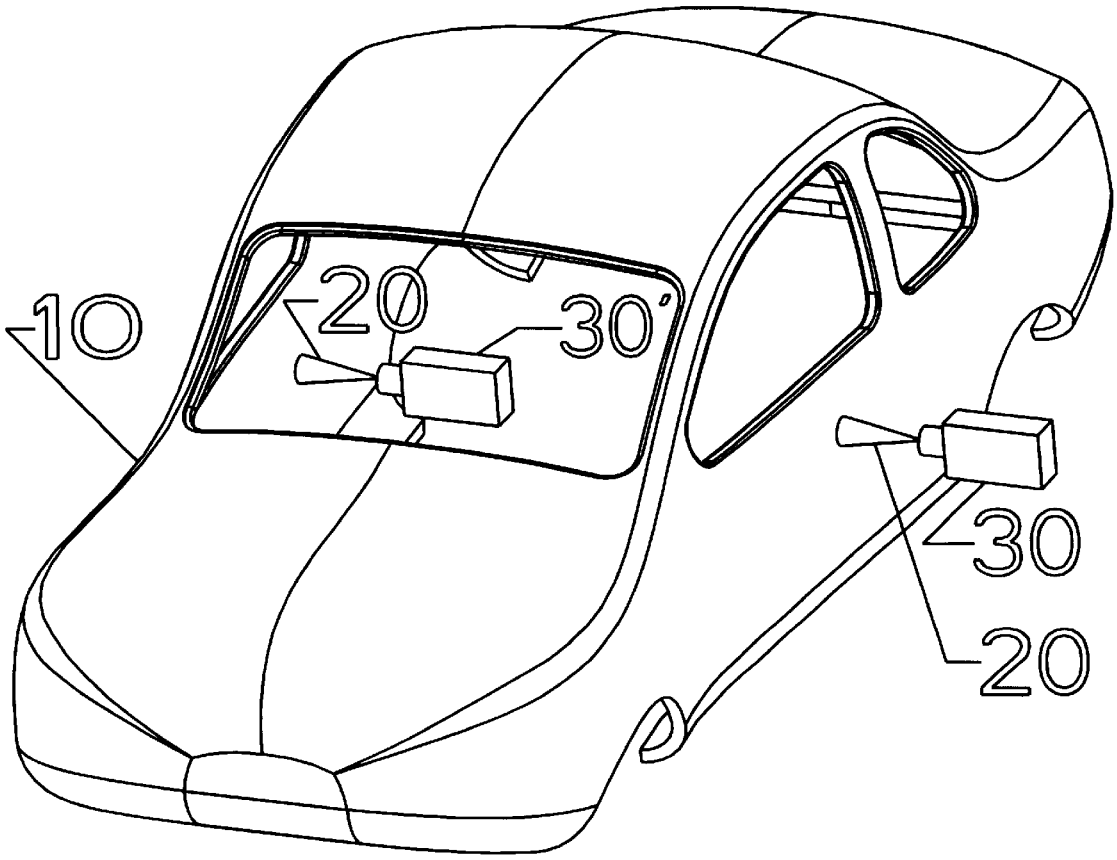
FIG. 1 shows a formed substrate in the shape of a vehicle body core, or shell, and one possible embodiment of thermal spray devices applying thermal spray material to its exterior surfaces. Not shown are the means to cover the entire vehicle body shell with the thermal spray material using a manipulation of one said component relative to the other or the use of multiple thermal spray devices.

A typical embodiment of the process of the present invention is illustrated in FIG. 1. The process is defined by a substrate material which has been formed in the shape of vehicle body core, or shell, 10. The substrate forming process can be manual fabrication, numerically controlled machining, molding, or any combination of these. Several smaller subcomponents, or modules, of the shell can be assembled together to form the final shape to be thermal sprayed in order to facilitate fabrication. The shape and design of the substrate can be determined by styling, engineering, safety, fabrication, manufacturing, and other considerations.

The formed substrate may or may not include those regions of the vehicle body traditionally defining the doors, hood, decklid, sunroof, floorpan, dash, front fenders or other panels. These panels may or may not be manufactured utilizing the process of this invention. If not included in the vehicle body shell, these panels would be manufactured separately and attached to the body in subsequent operations.

Figure 2:
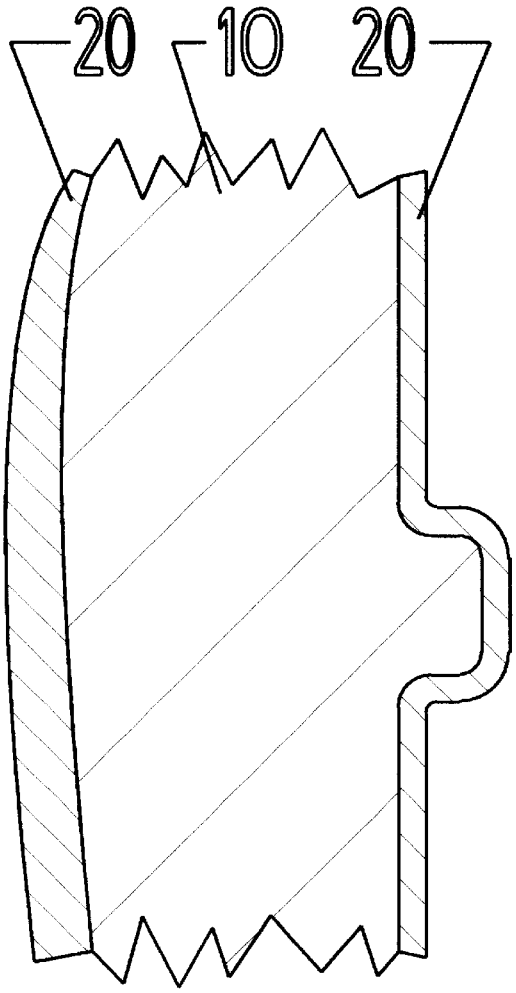
FIG. 2 shows a typical cross-section of a closed sandwich composite structure fabricated by thermal spraying on all sides of a substrate core material.

A coating of thermal spray material 20 is applied to the surfaces of the formed substrate by one or more thermal spray application devices 30 and 30' to produce a structure as seen in FIG. 2. In the prefered embodiment, the substrate material is comprised of a lightweight thermally insulating foam which is not burned or degraded when sprayed. The prefered thermal spray material is a lightweight metalic material such as aluminum. Wire-arc metal thermal spray is appropriate for this application.

The surfaces of the substrate material are designed such that when the thermal spray is applied and built up to the desired thicknesses, the result will be the creation of a composite structure consisting of the substrate material and the thermal spray material on one or more of the substrate surfaces. This composite structure then defines the vehicle body structure, or some portion of it, if the process is being used on smaller portions of the vehicle body. These smaller portions would then be assembled together in subsequent operations.

Figure 3:
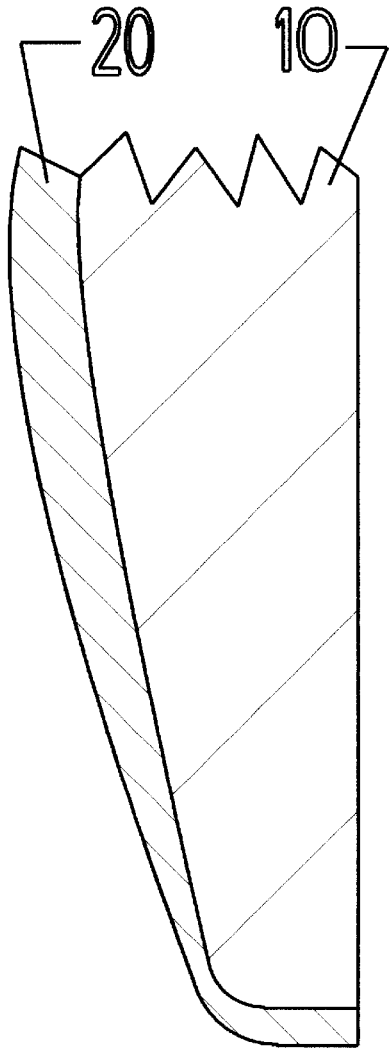
FIG. 3 shows a typical cross-section of an open composite structure fabricated by thermal spraying on only some sides of a substrate core material.

The thicknesses of the thermal spray material are determined by need. In areas of the vehicle where additional material is required, the thermal spray coating is thicker and in areas of minimal requirement, the thermal spray coating is thinner. Some vehicle shell regions may not require thermal spray on all sides as in FIG. 3.

Thermal spray application equipment is available from Sulzer Metco, a division of the Swiss company, Sulzer Corporation. Sulzer Metco (US) Inc. has an office in Westbury, N.Y.

A means is required to cover the vehicle body core with thermal spray material to the level necessary. The following is a partial list of possible ways to apply the thermal spray material to the formed vehicle substrate:

(a) A single thermal spray application device will be manipulated about the vehicle substrate. This can be accomplished manually, using robotic manipulators, automated machinery, or any combination of these.

(b) Multiple thermal spray application devices will be manipulated about the vehicle substrate. This can be accomplished manually, using robotic manipulators, automated machinery, or any combination of these.

(c) Many thermal spray devices can be utilized such that manipulation is not required.

(d) The vehicle substrate can be manipulated about the thermal spray application device or devices.

OPERATION—FIG. 1

The process of this invention begins with a substrate material which has been formed to define a vehicle body core, or shell, 10. This shell is to become the core of a composite structure and has been designed in anticipation of receiving a thermal spray coating. That is, its cross-sectional shape is pre-determined and the thermal spray coating will add to the final overall size and shape of the structure.

A coating of thermal spray material 20 is applied to selected, (all or some), surfaces of the vehicle body core. The thermal spray coating can be applied thicker in some regions and thinner in others in order to optimize strength and weight. The result is a composite structure which defines the vehicle body architecture.

One or more thermal spray devices 30 and 30' can be utilized to cover the vehicle body shell with thermal spray material. A means is provided to manipulate the thermal spray device(s) relative to the vehicle body shell or the vehicle body shell relative to the thermal spray device(s), if necessary, in order to achieve the desired level of thermal spray coverage. The means include manual manipulation, robotic manipulation, the usage of automated machinery, and any combination of these.

SUMMARY, RAMIFICATION, AND SCOPE

Accordingly, the thermal spray vehicle body manufacturing process of this invention offers a simpler manufacturing alternative to the predominant process in use today. Currently, most vehicle manufacturers utilize a process which involves stamping metal panels in complex die stamping lines. Subsequently, most metal panels are welded together to form subassemblies and ultimately the final assembly which defines the vehicle body produced using present techniques. The thermal spray vehicle body manufacturing process of this invention has less steps, deals with a reduced number of vehicle components and reduces or eliminates welding compared with current methods.

The reader will see that the thermal spray vehicle body manufacturing process of this invention can be used to produce a vehicle body that has significant advantages over vehicle bodies manufactured by conventional stamped metal panel processes. The vehicle bodies produced by the manufacturing process of this invention will be lighter weight, structurally superior, safer for the vehicle occupants, and will contain fewer parts than the vehicle bodies that they replace.

While the above description contains many specifities, these should not be construed as limitations on the scope of the invention, but rather as an exemplification of one preferred embodiment thereof. Many other variations are possible. For example, smaller portions, or modules, of the vehicle substrate shell can be coated with thermal spray material and then assembled to complete the vehicle body structure. The smaller shell modules can be defined by the vehicle's longitudinal plane of symmetry and transverse cuts placed forward and aft of the passenger compartment.

Other possible embodiments have the vehicle substrate shell without any substrate material in the door, hood, decklid, front fender or sunroof regions. After the vehicle substrate shell is thermal spray coated, these regions would be filled in by panels made by the process of this invention or more conventional processes.

Accordingly, the scope of this invention should be determined not by the embodiment illustrated, but by the appended claims and their legal equivalents.

I claim:

1. A manufacturing process for an automotive vehicle body comprising the steps of:

a. forming a substrate material of lightweight thermally insulating foam into an automotive vehicle body core of predetermined shape, said core being formed with walls of predetermined thicknesses defining an enclosed space within said automotive vehicle body, and whereby the approximate exterior form and cross-sectional thicknesses of said automotive vehicle body are defined by said core; and b. thermal spray coating both inner and outer sides of said core walls with a metallic thermal spray coating material, whereby said substrate material and applied thermal spray coating material will define a composite automotive vehicle body structure made up of said substrate material and said thermal spray material.

2. The process according to claim 1, wherein said thermal spray material is aluminum.

3. The process according to claim 1 wherein said enclosed space defined by said core walls is a passenger compartment of said automotive vehicle body.

* * * * *